US008294630B2

(12) United States Patent
Chen et al.

(10) Patent No.: US 8,294,630 B2
(45) Date of Patent: Oct. 23, 2012

(54) ELECTRONIC DEVICE AND ANTENNA THEREOF

(75) Inventors: Huang-Chih Chen, Taipei Hsien (TW); Yung-Jinn Chen, Taipei (TW)

(73) Assignee: Wistron NeWeb Corp., Hsinchu (TW)

( * ) Notice: Subject to any disclaimer, the term of this patent is extended or adjusted under 35 U.S.C. 154(b) by 581 days.

(21) Appl. No.: 12/431,582

(22) Filed: Apr. 28, 2009

(65) Prior Publication Data

US 2010/0188297 A1 Jul. 29, 2010

(30) Foreign Application Priority Data

Jan. 23, 2009 (TW) ..... 98102829 A

(51) Int. Cl.

| | |
|---|---|
| ***H01Q 9/16*** | (2006.01) |
| ***H01Q 9/26*** | (2006.01) |
| ***H01Q 9/28*** | (2006.01) |
| ***H01Q 1/38*** | (2006.01) |
| ***H01Q 1/24*** | (2006.01) |

(52) U.S. Cl. . 343/793; 343/803; 343/807; 343/700 MS; 343/702; 343/795

(58) Field of Classification Search ..... 343/702, 343/700 MS

See application file for complete search history.

(56) References Cited

U.S. PATENT DOCUMENTS

| | | | | |
|---|---|---|---|---|
| 6,639,559 | B2 * | 10/2003 | Okabe et al. | 343/700 MS |
| 7,126,545 | B2 * | 10/2006 | Nagano et al. | 343/702 |
| 7,382,319 | B2 * | 6/2008 | Kawahata et al. | 343/700 MS |
| 2007/0200782 | A1 * | 8/2007 | Hayama et al. | 343/795 |

FOREIGN PATENT DOCUMENTS

| | | |
|---|---|---|
| KR | 20020071779 | 9/2002 |
| KR | 20070077094 | 7/2007 |

* cited by examiner

*Primary Examiner* — Jacob Y Choi
*Assistant Examiner* — Graham Smith

(57) ABSTRACT

An antenna is provided. The antenna includes a signal line, a ground line, a first radiation element and a second radiation element. The first radiation element is electrically connected to the signal line. The first radiation element includes a first U-shaped section and a first extension section. The signal line is connected to an end of the first U-shaped section, and the first extension section is connected to the other end thereof. The first U-shaped section includes a first notch toward a first direction. The second radiation element is electrically connected to the ground line. The second radiation element includes a second U-shaped section and a second extension section. The ground line is connected to an end of the second U-shaped section, and the second extension section is connected to the other end thereof. The second U-shaped section includes a second notch toward the first direction.

15 Claims, 12 Drawing Sheets

320

ELECTRONIC DEVICE AND ANTENNA THEREOF

CROSS REFERENCE TO RELATED APPLICATIONS

This Application claims priority of Taiwan Patent Application No. 098102829, filed on Jan. 23, 2009, the entirety of which is incorporated by reference herein.

BACKGROUND OF THE INVENTION

1. Field of the Invention

The present invention relates to an antenna, and in particular relates to a dipole antenna.

2. Description of the Related Art

FIG. 1 shows a conventional dipole antenna 1, comprising a first arm 10, a second arm 20, a signal line 31 and a ground line 32. The signal line 31 is electrically connected to the first arm 10. The ground line 32 is electrically connected to the second arm 20. The dipole antenna 1 transmits a wireless signal, and the wireless signal has a wave length $\lambda$.

Conventionally, the lengths of the first arm 10 and the second arm 20 are $\lambda/4$. The dipole thus has increased volume. Additionally, the dipole antenna 1 has only one mode resonance frequency for surface current to travel thereon along only one path. Thus, the bandwidth thereof is decreased, and bandwidth utility rate is only about 8.15%.

BRIEF SUMMARY OF THE INVENTION

A detailed description is given in the following embodiments with reference to the accompanying drawings.

An antenna is provided. The antenna includes a signal line, a ground line, a first radiation element and a second radiation element. The first radiation element is electrically connected to the signal line. The first radiation element includes a first U-shaped section and a first extension section. The signal line is connected to an end of the first U-shaped section, and the first extension section is connected to the other end thereof. The first U-shaped section includes a first notch toward a first direction. The second radiation element is electrically connected to the ground line. The second radiation element includes a second U-shaped section and a second extension section. The ground line is connected to an end of the second U-shaped section, and the second extension section is connected to the other end thereof. The second U-shaped section includes a second notch toward the first direction.

In the embodiment, the antenna is bent non-equidistantly, and the line width of the antenna is non-uniformed. The surface current on the antenna travels circuitously to provide multimode resonance. The antenna provides increased bandwidth and improved transmission with reduced volume.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
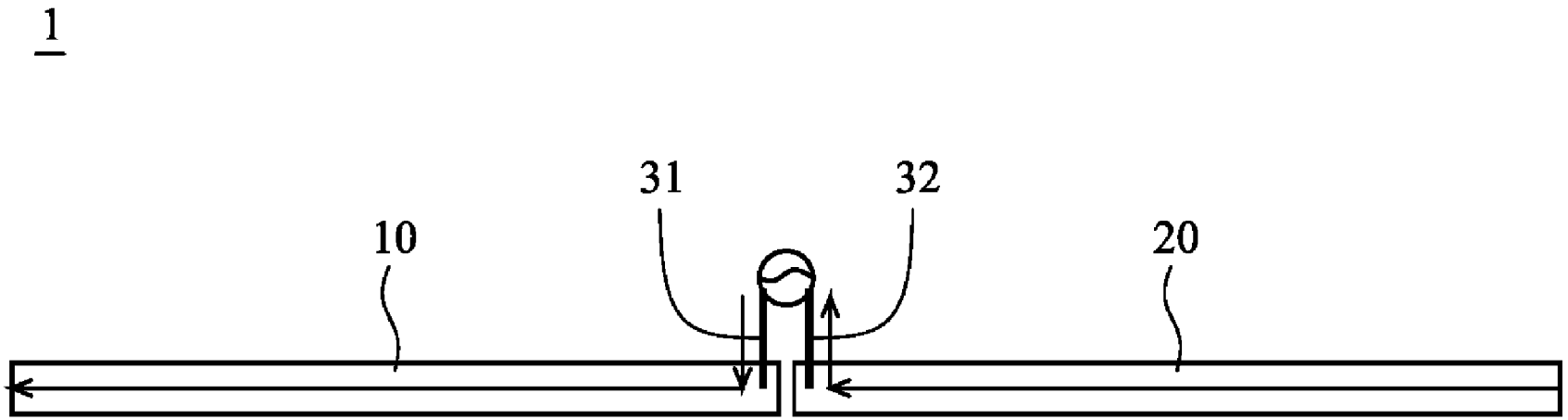
FIG. 1 ( PRIOR ART )
FIG. 1 shows a conventional dipole antenna.
Figure 2:
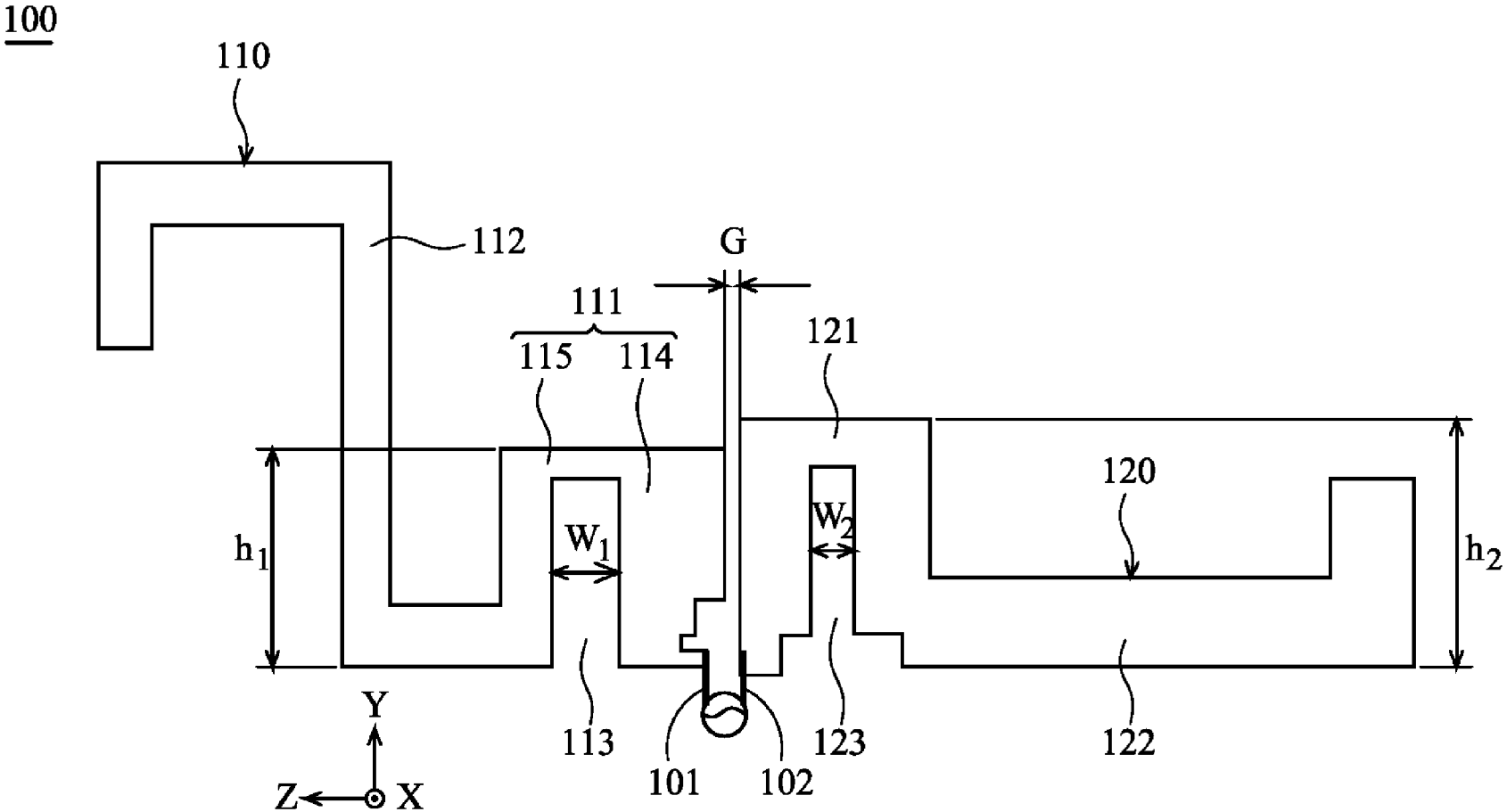
FIG. 2 shows an antenna of a first embodiment of the invention.

FIG. 2 shows an antenna 100 of a first embodiment of the invention, comprising a signal line 101, a ground line 102, a first radiation element 110 and a second radiation element 120. The first radiation element 110 is electrically connected to the signal line 101. The first radiation element 110 comprises a first U-shaped section 111 and a first extension section 112. The signal line 101 is connected to an end of the first U-shaped section 111. The first extension section 112 is connected to the other end of the first U-shaped section 111. The first U-shaped section 111 has a first notch 113. The first notch 113 is toward a first direction (−Y). The second radiation element 120 is electrically connected to the ground line 102. The second radiation element 120 comprises a second U-shaped section 121 and a second extension section 122. The ground line 102 is connected to an end of the second U-shaped section 121. The second extension section 122 is connected to the other end of the second U-shaped section 121. The second U-shaped section 121 has a second notch 123. The second notch 123 is toward the first direction (−Y). The first U-shaped section 111 is near the second U-shaped section 121.

Figure 3A:
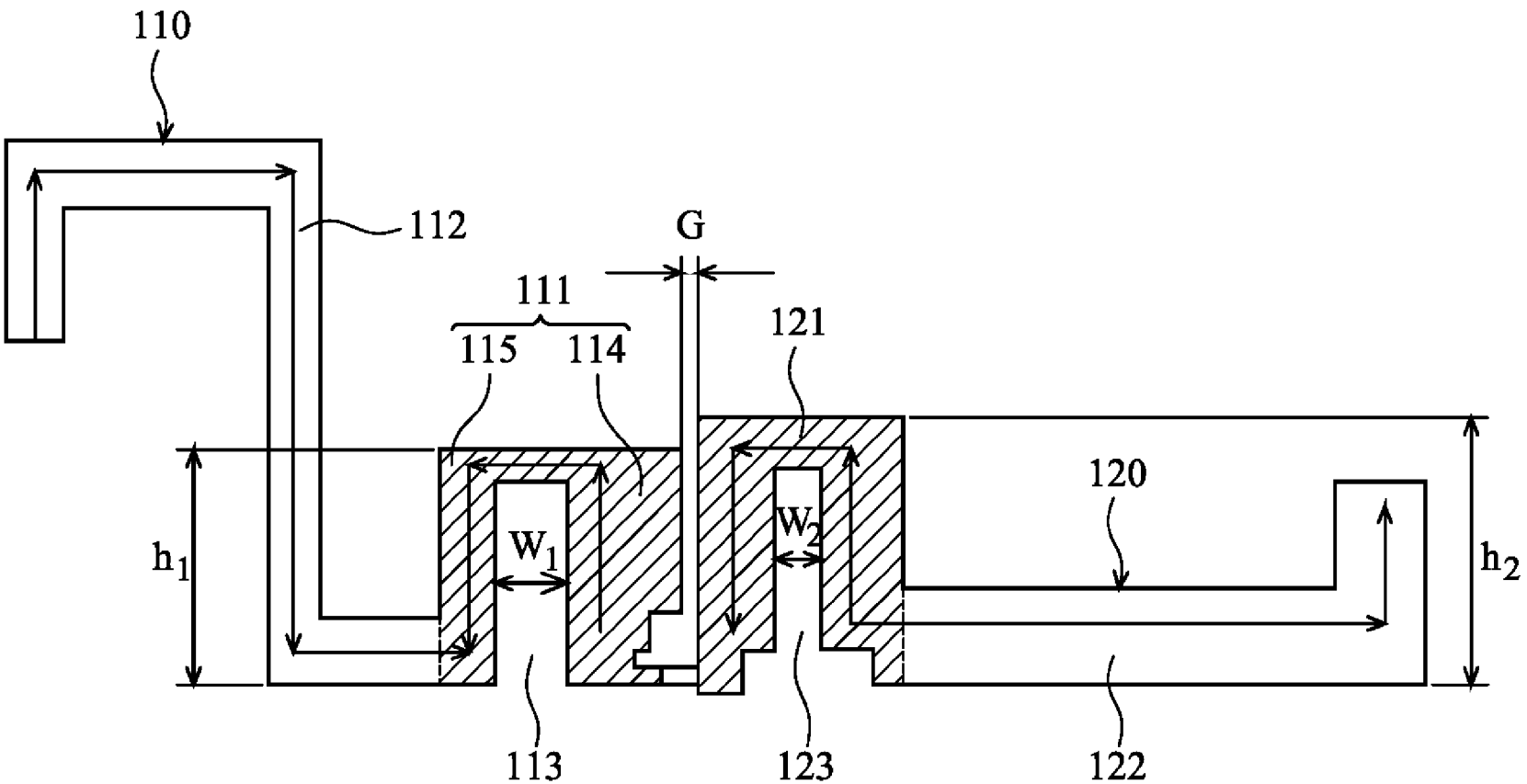
FIG. 3*a* shows the antenna of the first embodiment transmitting a first wireless signal (high frequency signal)

With reference to FIG. 3*a*, when the antenna 100 transmits a first wireless signal (high frequency signal), the first U-shaped section 111 couples the second U-shaped section 121 to transmit the first wireless signal, the first wireless signal has a first signal wavelength $\lambda_1$, and the sum $h_1$ of a depth and a line width of the first U-shaped section 111 is between $\lambda_1/3$ and $\lambda_1/2$. FIG. 3*a* shows a path of surface current of the embodiment, wherein when the first wireless signal is transmitted, the surface current is gathered on the first U-shaped section 111 and the second U-shaped section 121.

Figure 3B:
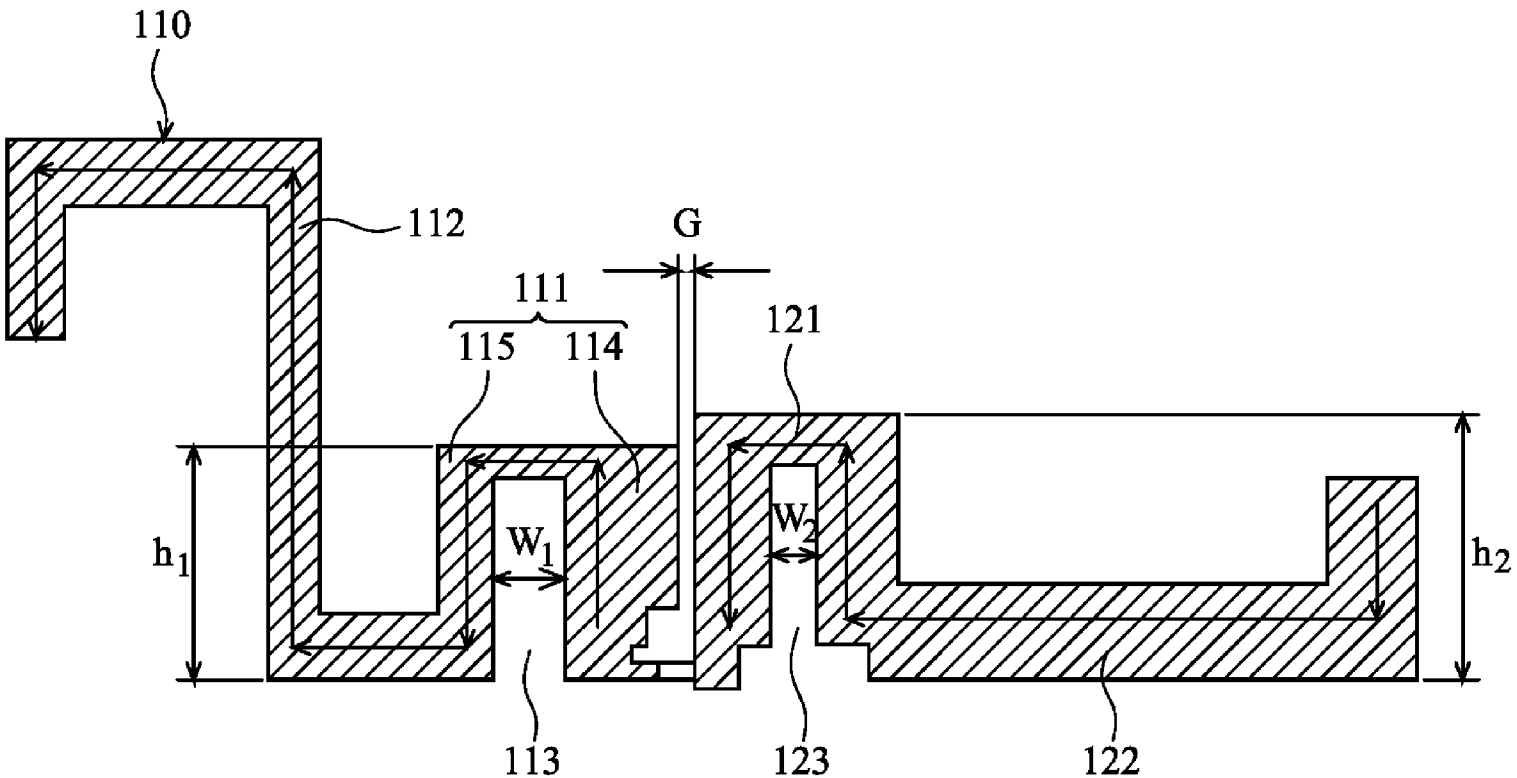
FIG. 3*b* shows the antenna of the first embodiment transmitting a second wireless signal (low frequency signal)

With reference to FIG. 3*b*, when the antenna transmits a second wireless signal (low frequency signal), the second wireless signal is transmitted via the first U-shaped section 111, the first extension section 112, the second U-shaped section 121 and a second extension section 122. The second wireless signal has a second wavelength $\lambda_2$. The total length of the first radiation element 110 is about $\lambda_2/4$, and the total length of the second radiation element 120 is about $\lambda_2/4$.

With reference to FIG. 2, in the embodiment, the sum $h_2$ of a depth and a line width of the second U-shaped section 121 is greater than the sum $h_1$ of the depth and the line width of the first U-shaped section 111.

The first U-shaped section 111 comprises a first major coupling portion 114 and a first minor coupling portion 115. The first major coupling portion 114 is disposed between the first minor coupling portion 115 and the signal line 101. A line width of the first major coupling portion 114 is greater than a line width of the first minor coupling portion 115. The line width of the first major coupling portion 114 is greater than the line width of the second U-shaped section 121. The line width of the first minor coupling portion 115 is thinner than the line width of the second U-shaped section 121. The width $w_1$ of the first notch 113 is greater than the width $w_2$ of the second notch 123.

A gap G is formed between the first U-shaped section 111 and the second U-shaped section 121. The position of the first U-shaped section 111 relative to the second U-shaped section 121 can be modified to improve coupling effect and to prevent current offset problem.

In the embodiment, the antenna is bent non-equidistantly, and the line width of the antenna is non-uniformed. In one embodiment, the sum $h_1$ of the depth and the line width of the first U-shaped section 111 is about $0.4\lambda_1$, and the sum $h_2$ of the depth and the line width of the second U-shaped section 121 is about $0.45\lambda_1$. The line width of the first major coupling portion 114 is about $0.17\lambda_1$. The line width of the first minor coupling portion 115 is about $0.05\lambda_1$. The line width of the second U-shaped section 121 is about $0.1\lambda_1$. The width $w_1$ of the first notch 113 is about $0.1\lambda_1$. The width $w_2$ of the second notch 123 is about $0.05\lambda_1$. The gap G is about $0.1\lambda_1$.

Figure 4:
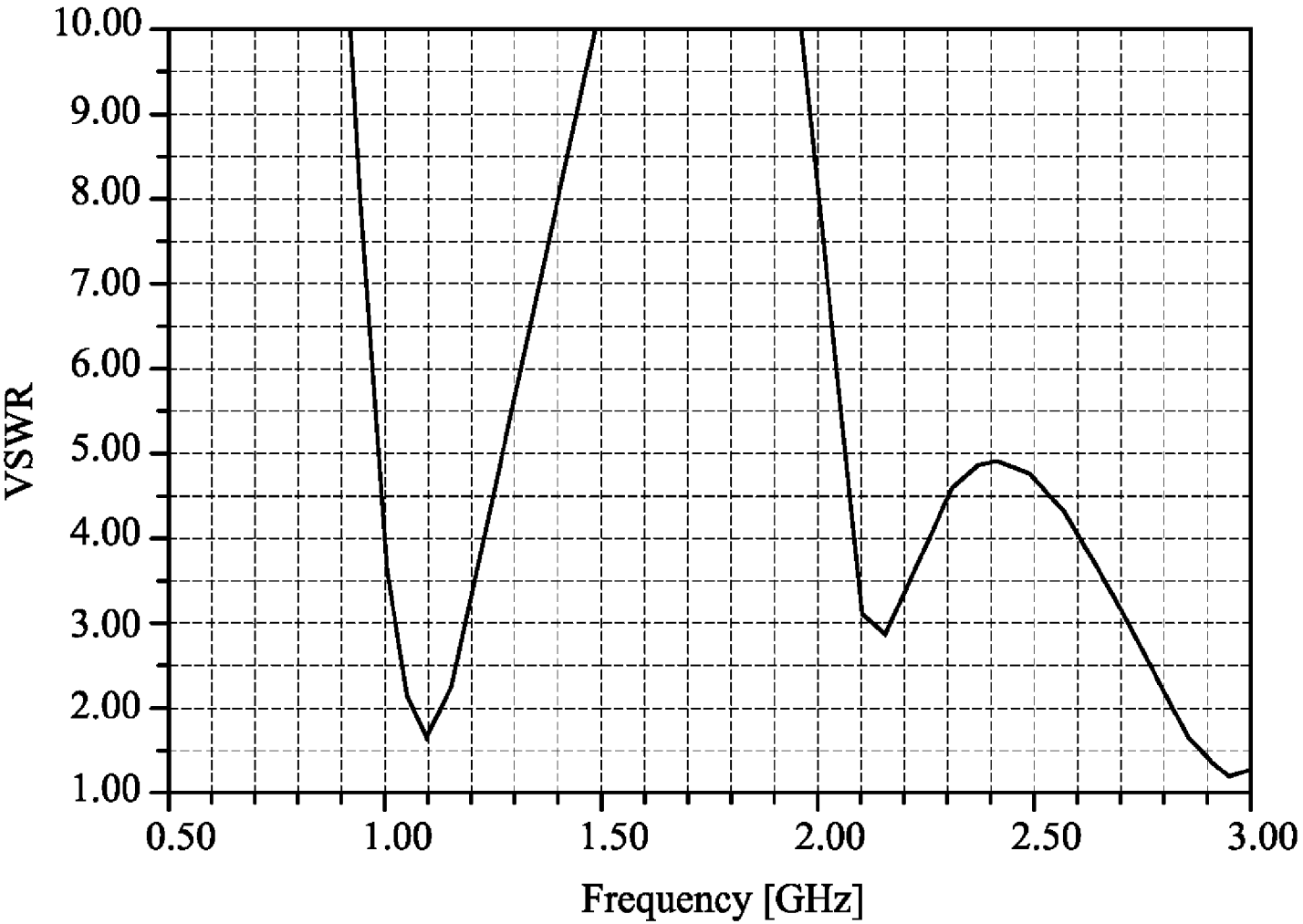
FIG. 4 shows the transmission of the antenna of the first embodiment.

FIG. 4 shows the transmission of the antenna of the first embodiment, wherein the bandwidth of the antenna is between 1.05 GHz~1.18 GHz and between 2.7 GHz~3.0 GHz. The bandwidth utility rate is about 11.6%~10.5%. The antenna of the first embodiment provides increased bandwidth and improved transmission with reduced volume.

Figure 5A:
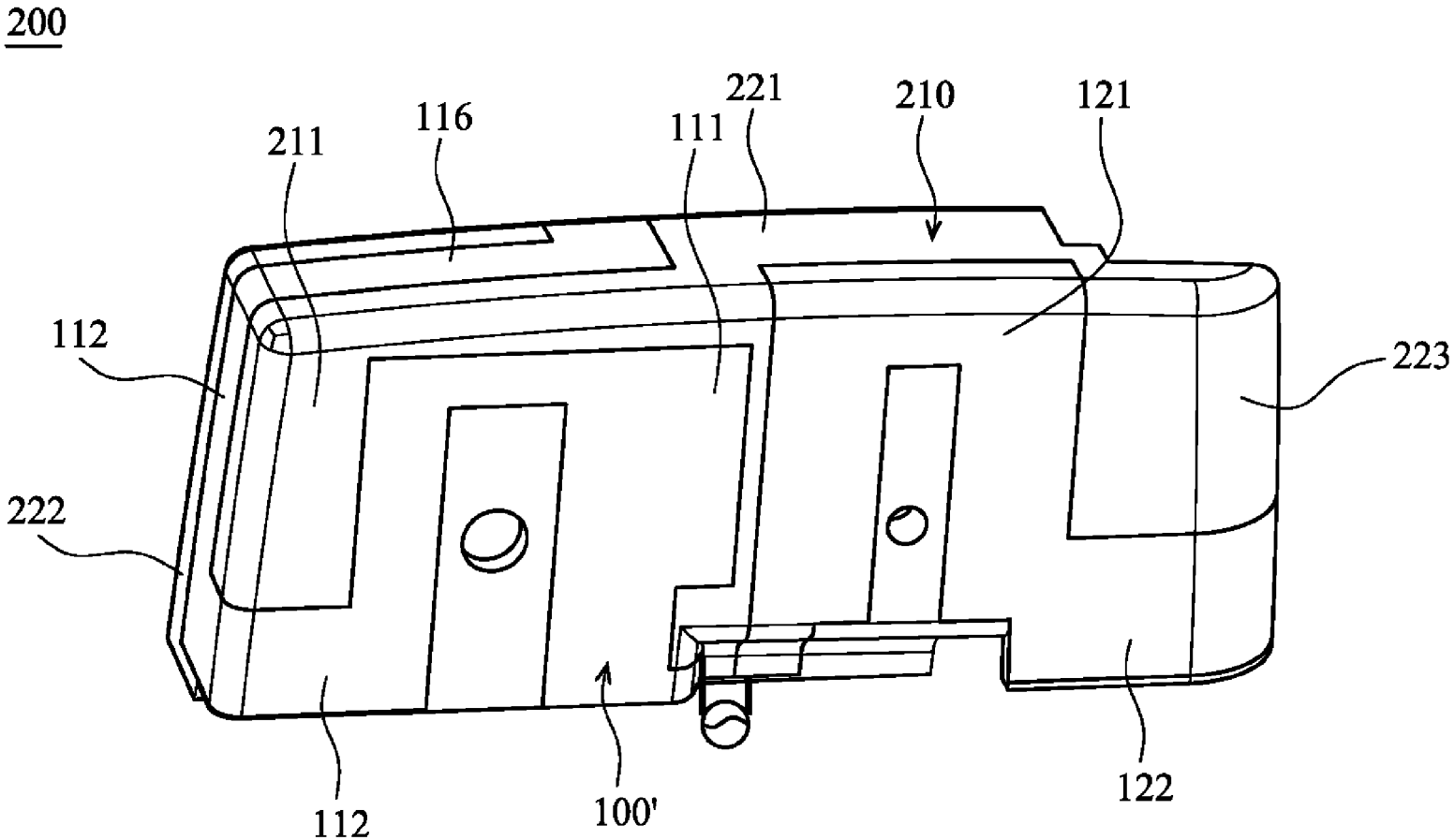
FIGS. 5*a* and 5*b* show an electronic device of a second embodiment of the invention.
Figure 5B:
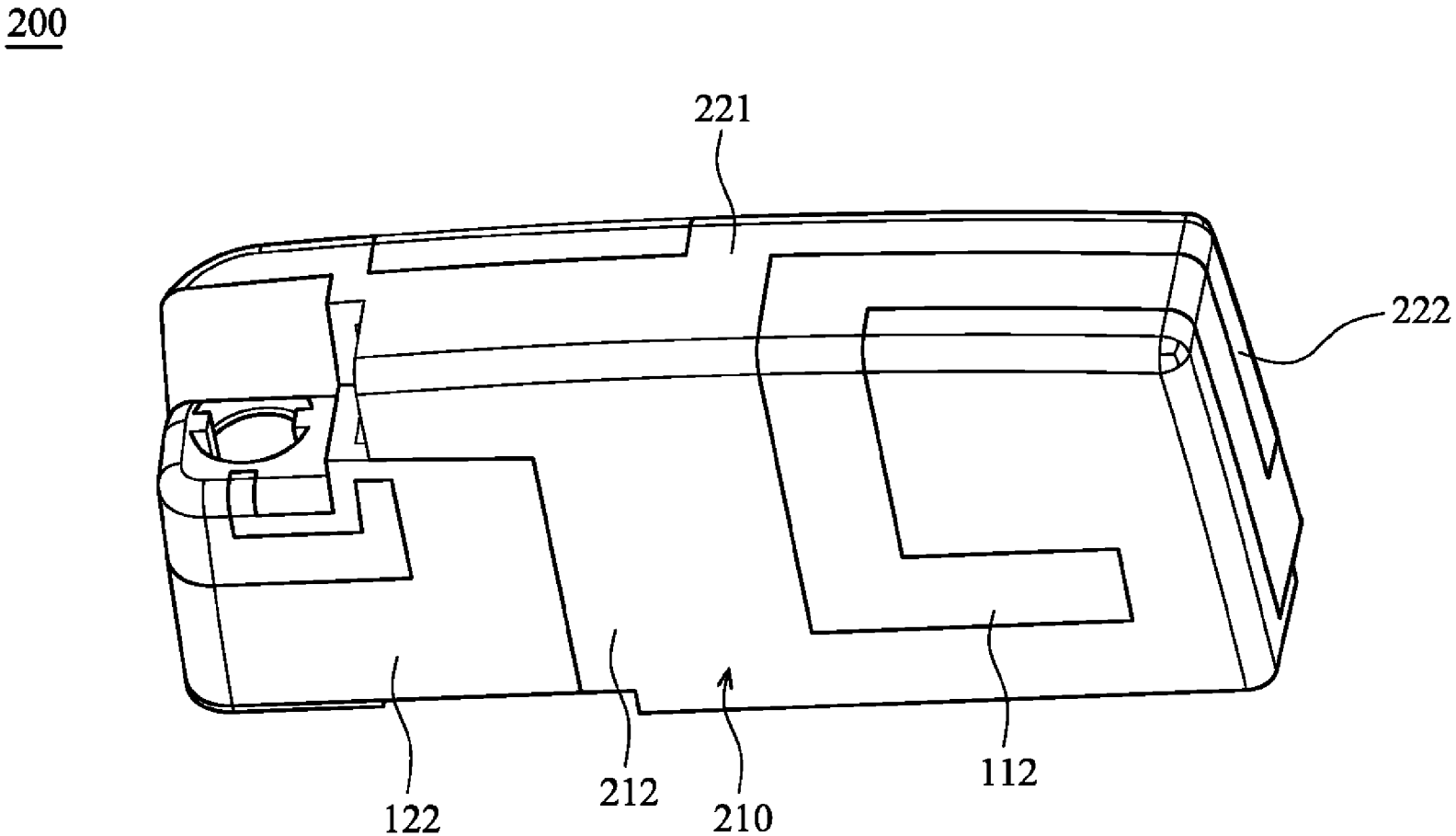

FIGS. 5*a* and 5*b* show an electronic device 200 of a second embodiment of the invention, which comprises a supporting structure 210 and an antenna 100'. The antenna 100' is printed on the supporting structure 210. The structure of the antenna 100' is substantially similar to the antenna 100 of the first embodiment. The supporting structure 210 comprises a first major supporting surface 211, a second major supporting surface 212, a first lateral supporting surface 221, a second lateral supporting surface 222 and a third lateral supporting surface 223. The first major supporting surface 211 is parallel to the second major supporting surface 212. The first lateral supporting surface 221 is substantially perpendicular to the first major supporting surface 211. The second lateral supporting surface 222 is substantially perpendicular to the first major supporting surface 211 and the first lateral supporting surface 221. The third lateral supporting surface 223 is substantially opposite to the second lateral supporting surface 222.

The first U-shaped section 111 and the second U-shaped section 121 are located on the first major supporting surface 211. The first extension section 112 extends from the first major supporting surface 211, passing through the second lateral supporting surface 222, and the first lateral supporting surface 211 to the second major supporting surface 212. The second extension section 122 extends from the first major supporting surface 211, passing through the third lateral supporting surface 223 to the second major supporting surface 212.

With reference to FIG. 5*a,* the first extension section 112 has a first extension coupling portion 116. The first extension coupling portion 116 extends on the first lateral supporting surface 221 and couples the central portion (top portion) of the first U-shaped section 111.

Figure 6:
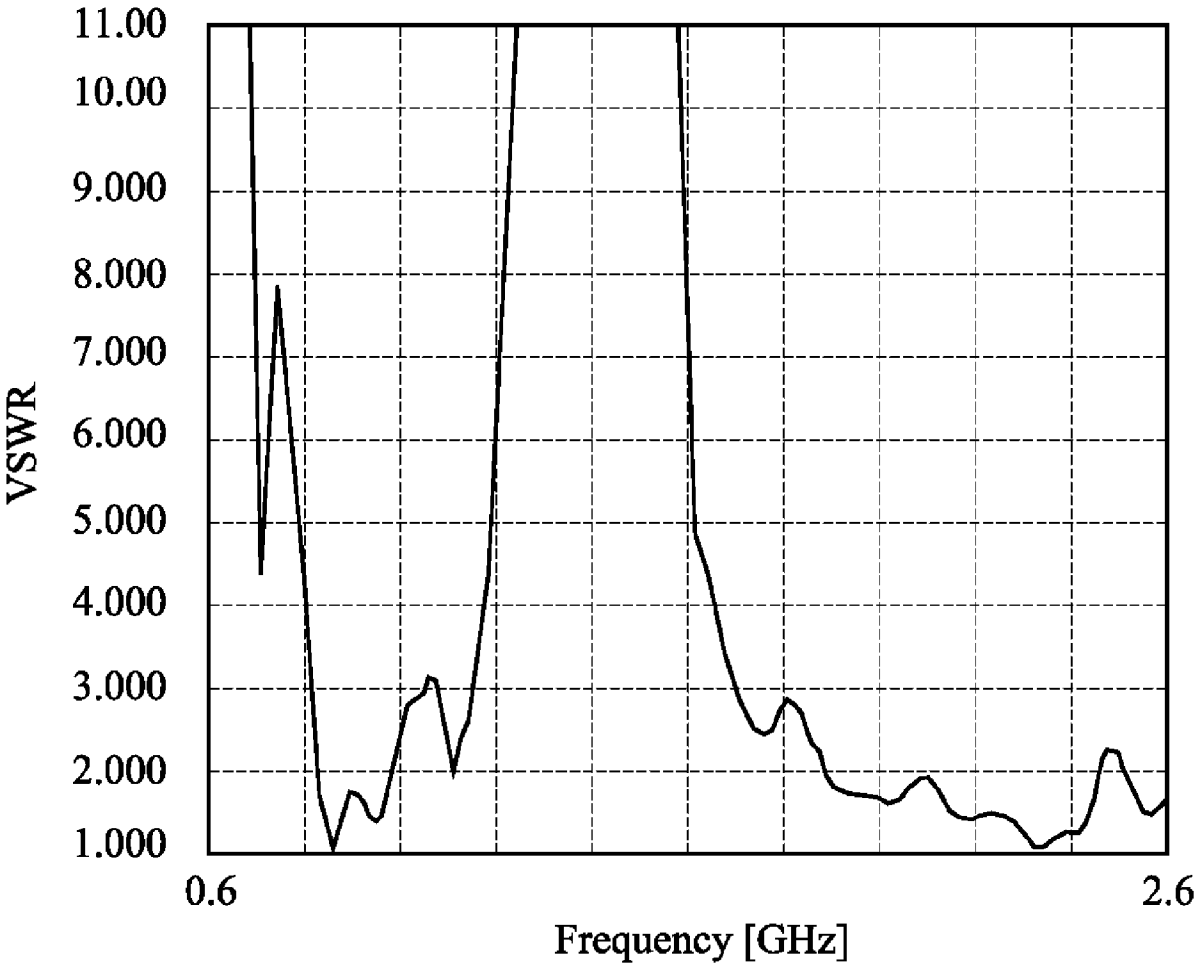
FIG. 6 shows the transmission of the antenna of the second embodiment.
Figure 7A:
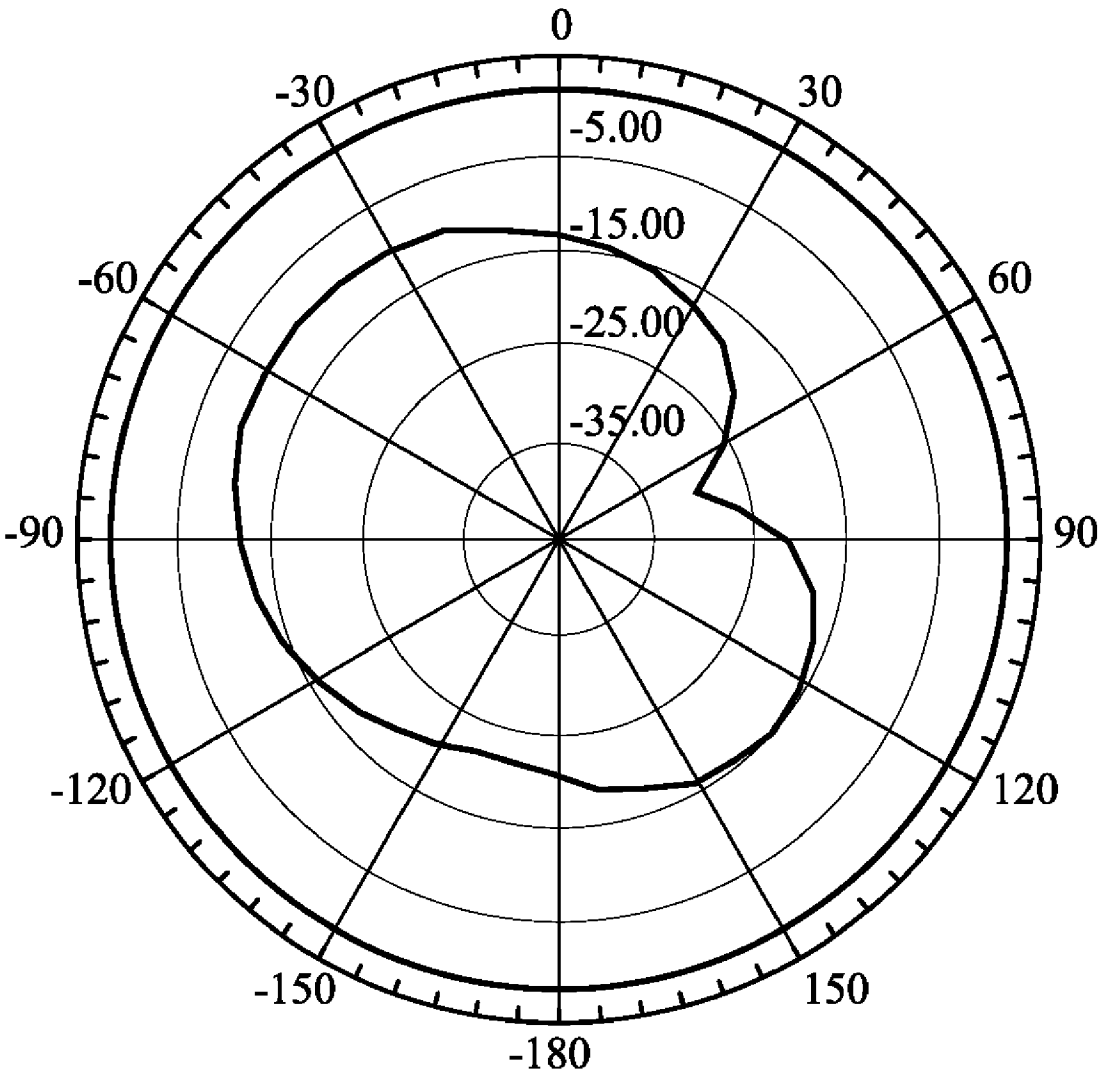
FIG. 7*a* shows an X-Y plane divergence field of the second embodiment at a low frequency module.
Figure 7B:
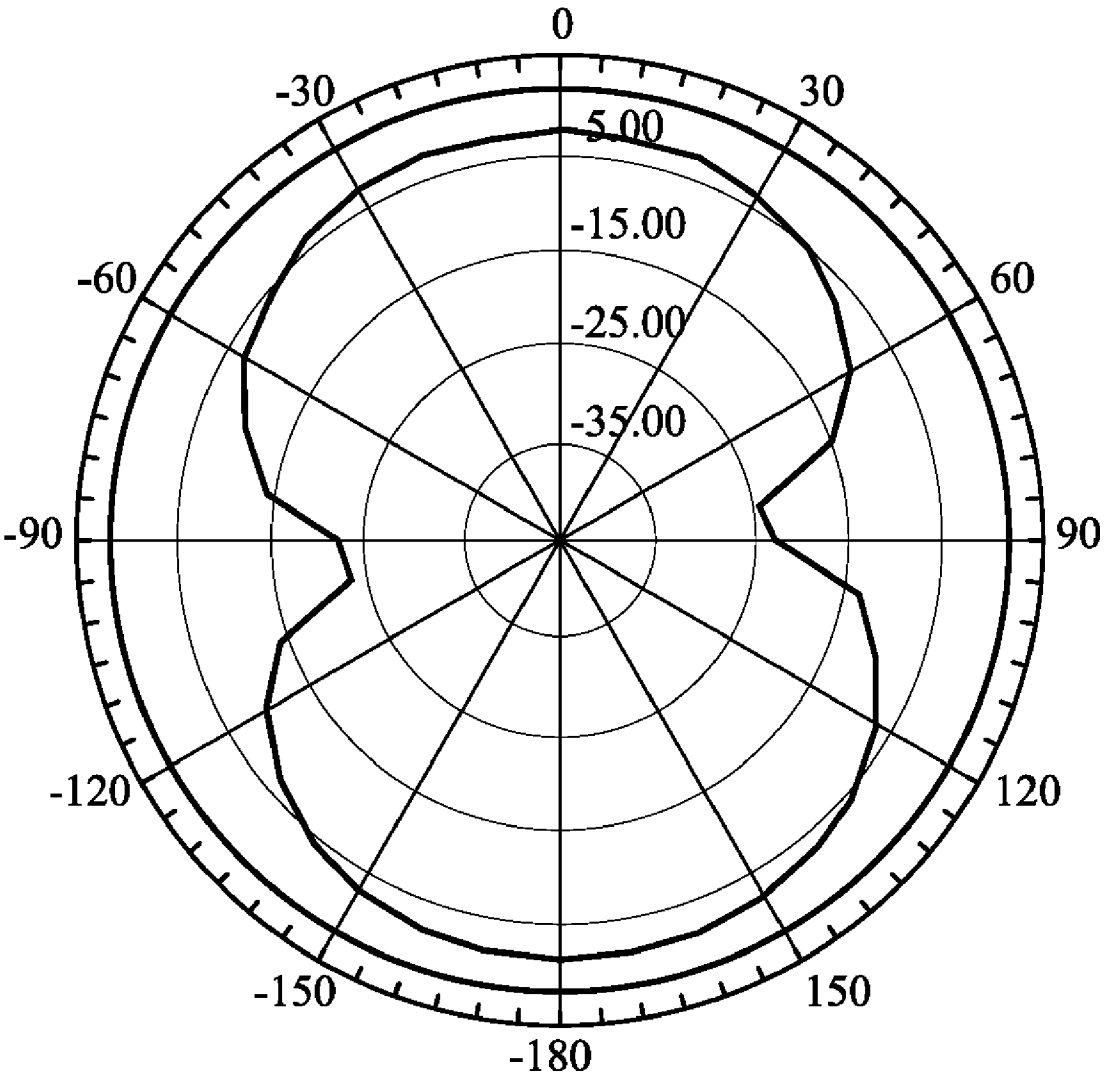
FIG. 7*b* shows an X-Y plane divergence field of the second embodiment at a high frequency module.

FIG. 6 shows the transmission of the antenna of the second embodiment, wherein the bandwidth of the antenna is between 824 MHz~960 MHz (low frequency) and between 1710 MHz~2500 MHz (high frequency). The bandwidth utility rate at the low frequency band is about 15.24%. The bandwidth utility rate at the high frequency band is about 37.53%. Compared to the first embodiment, the antenna of the second embodiment has smaller volume and improved transmission. With reference to FIGS. 7*a* and 7*b,* FIG. 7*a* shows an X-Y plane divergence field of the second embodiment at a low frequency module, and FIG. 7*b* shows an X-Y plane divergence field of the second embodiment at a high frequency module. The antenna of the second embodiment provides sporadic omnidirectional radiation on the X-Y plane.

The electronic device 200 of the second embodiment can be an external direct-connect wireless LAN card or other electronic devices.

Figure 8:
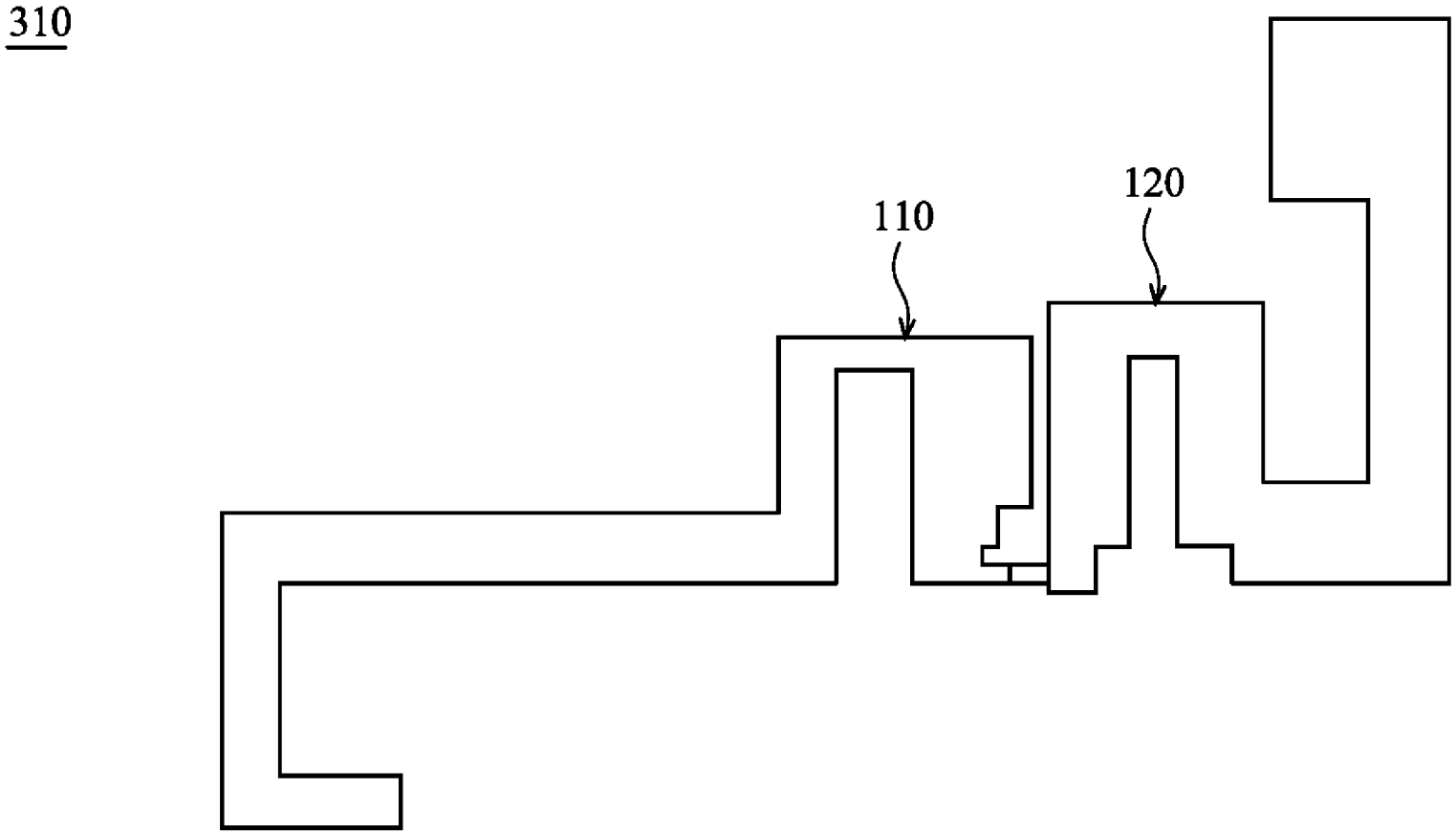
FIG. 8 shows an antenna of a third embodiment of the invention.
Figure 9:
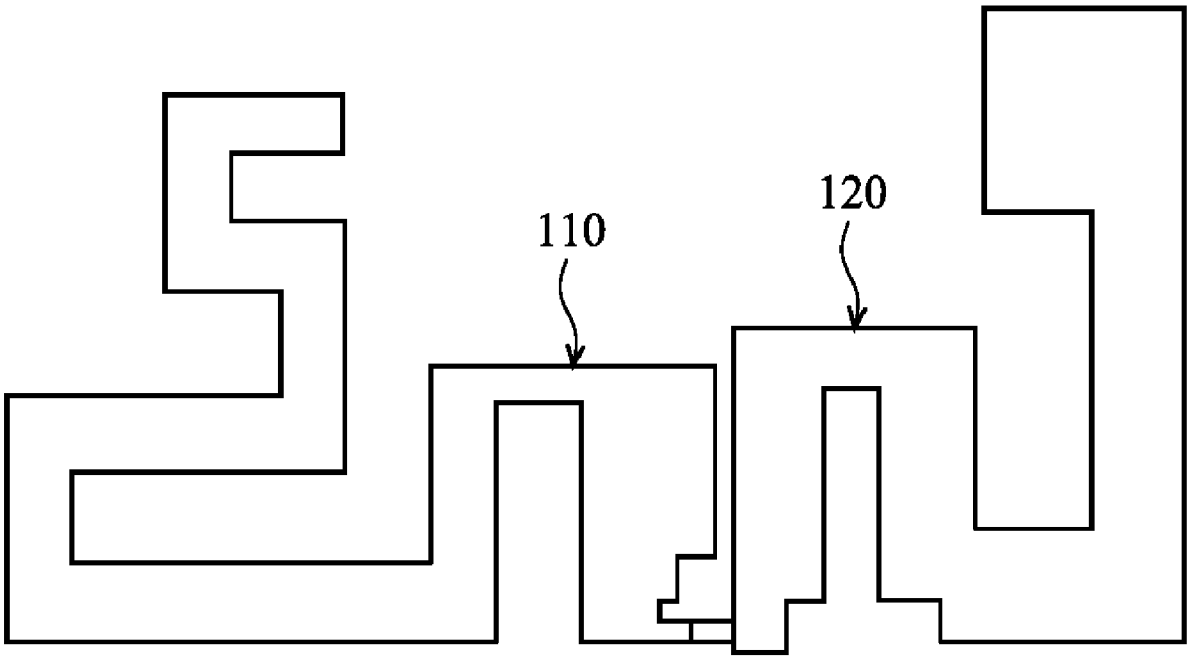
FIG. 9 shows an antenna of a fourth embodiment of the invention.

FIG. 8 shows an antenna 310 of a third embodiment of the invention. FIG. 9 shows an antenna 320 of a fourth embodiment of the invention. As shown in FIGS. 8 and 9, the shapes of the first and second extension section can be changed to satisfy various transmission requirements, for example, to change a divergence field or to change a band.

In the embodiments, the first U-shaped section and the second U-shaped section are substantially on the same plane. However, the invention is not limited thereto. The first U-shaped section and the second U-shaped section can be located on different planes, and the first U-shaped section can couple the second U-shaped section to proved multi-mode resonance.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An antenna, comprising:

a signal line;

a ground line;

a first radiation element, electrically connected to the signal line, comprising a first U-shaped section and a first extension section, wherein the signal line is connected to an end of the first U-shaped section, the first extension section is connected to the other end of the first U-shaped section, the first U-shaped section comprises a first notch, and the first notch extends longitudinally in a first direction; and a second radiation element, electrically connected to the ground line, comprising a second U-shaped section and a second extension section, wherein the ground line is connected to an end of the second U-shaped section, the second extension section is connected to the other end of the second U-shaped section, the second U-shaped section comprises a second notch, the second notch extends longitudinally in the first direction, the first U-shaped section is near the second U-shaped section, when the antenna transmits a first wireless signal, the first U-shaped section couples the second U-shaped section to transmit the first wireless signal, the first wireless signal comprises a first wavelength $\lambda_1$, and a sum of a depth and a line width of the first U-shaped section is between $\lambda_1/3$ and $\lambda_1/2$, wherein a sum of a depth of the second notch in the first direction and a line width of a bottom of the second U-shaped section in the first direction is greater than the sum of the depth of the first notch in the first direction and the line width of a bottom of the first U-shaped section in the first direction, wherein the first U-shaped section comprises a first major coupling portion and a first minor coupling portion connected by the bottom of the first U-shaped section, the first major coupling portion is located between the first minor coupling portion and the signal line, and a line width of the first major coupling portion in a second direction perpendicular to the first direction is greater than a line width of the first minor coupling portion in the second direction, wherein the second U-shaped section comprises a first coupling portion and a second coupling portion connected by a bottom of the second U-shaped section, wherein the line width of the first major coupling portion in the second direction is greater than a maximum line width of both the first coupling portion and the second coupling portion of the second U-shaped section in the second direction.

2. The antenna as claimed in claim 1, wherein the line width of the first minor coupling portion in the second direction is thinner than the line width of both the first coupling portion and the second coupling portion of the second U-shaped section in the second direction.

3. The antenna as claimed in claim 1, wherein a width of the first notch is greater than a width of the second notch.

4. The antenna as claimed in claim 1, wherein when the antenna transmits a second wireless signal, the second wireless signal is transmitted via the first U-shaped section, the first extension section, the second U-shaped section and the second extension section, the second wireless signal comprises a second wave length $\lambda_2$, a total length of the first radiation element is about $\lambda_2/4$, and a total length of the second radiation element is about $\lambda_2/4$.

5. The antenna as claimed in claim 1, wherein the first extension section comprises a first extension coupling portion, and the first extension coupling portion couples the first U-shaped section.

6. The antenna as claimed in claim 5, wherein the first extension coupling portion couples and parallel to a central portion of the first U-shaped section.

7. An electronic device, comprising:

a supporting structure; and an antenna, disposed on the supporting structure, comprising:

a signal line;

a ground line;

a first radiation element, electrically connected to the signal line, comprising a first U-shaped section and a first extension section, wherein the signal line is connected to an end of the first U-shaped section, the first extension section is connected to the other end of the first U-shaped section, the first U-shaped section comprises a first notch, and the first notch extends longitudinally in a first direction; and a second radiation element, electrically connected to the ground line, comprising a second U-shaped section and a second extension section, wherein the ground line is connected to an end of the second U-shaped section, the second extension section is connected to the other end of the second U-shaped section, the second U-shaped section comprises a second notch, the second notch extends longitudinally in the first direction, the first U-shaped section is near the second U-shaped section, when the antenna transmits a first wireless signal, the first U-shaped section couples the second U-shaped section to transmit the first wireless signal, the first wireless signal comprises a first wavelength $\lambda_1$, and a sum of a depth and a line width of the first U-shaped section is between $\lambda_l/3$ and $\lambda_1/2$, wherein a sum of a depth of the second notch in the first direction and a line width of a bottom of the second U-shaped section in the first direction is greater than the sum of the depth of the first notch in the first direction and the line width of a bottom of the first U-shaped section in the first direction, wherein the first U-shaped section comprises a first major coupling portion and a first minor coupling portion connected by a bottom of the first U-shaped section, the first major coupling portion is located between the first minor coupling portion and the signal line, and a line width of the first major coupling portion in a second direction perpendicular to the first direction is greater than a line width of the first minor coupling portion in the second direction, wherein the second U-shaped section comprises a first coupling portion and a second coupling portion connected by a bottom of the second U-shaped section, wherein the line width of the first major coupling portion in the second direction is greater than a maximum line width of both the first coupling portion and the second coupling portion of the second U-shaped section in the second direction.

8. The electronic device as claimed in claim 7, wherein the supporting structure comprises a first major supporting surface, and the first U-shaped section and the second U-shaped section are formed on the first major supporting surface.

9. The electronic device as claimed in claim 7, wherein the line width of the first minor coupling portion in the second direction is thinner than the line width of both the first coupling portion and the second coupling portion of the second U-shaped section in the second direction.

10. The electronic device claimed in claim 7, wherein when the antenna transmits a second wireless signal, the second wireless signal is transmitted via the first U-shaped section, the first extension section, the second U-shaped section and the second extension section, the second wireless signal comprises a second wave length $\lambda_2$, a total length of the first radiation element is about $\lambda_2/4$, and a total length of the second radiation element is about $\lambda_2/4$.

11. The electronic device claimed in claim 7, wherein the first extension section comprises a first extension coupling portion, and the first extension coupling portion couples the first U-shaped section.

12. The electronic device as claimed in claim 8, wherein the first extension coupling portion couples and parallel to a central portion of the first U-shaped section.

13. The electronic device as claimed in claim 12, wherein the supporting structure further comprises a first lateral supporting surface, the first lateral supporting surface is substantially perpendicular to the first major supporting surface, and the first extension coupling portion is formed on the first lateral supporting surface.

14. The electronic device as claimed in claim 13, wherein the supporting structure further comprises a second lateral supporting surface and a second major supporting surface, the first extension section extends from the first major supporting surface, passing through the second lateral supporting surface, the first lateral supporting surface to the second major supporting surface, the first major supporting surface is parallel to the second major supporting surface, and the second lateral supporting surface is substantially perpendicular to the first major supporting surface and the first lateral supporting surface.

15. The electronic device as claimed in claim 14, wherein the supporting structure further comprises a third lateral supporting surface, and the second extension portion extends from the first major supporting surface, passing through the third lateral supporting surface to the second major supporting surface, and the third lateral supporting surface is substantially opposite to the second lateral supporting surface.

* * * * *